US006936390B2

(12) United States Patent
Nanya et al.

(10) Patent No.: US 6,936,390 B2
(45) **Date of Patent: *Aug. 30, 2005**

(54) TONER, METHOD OF PRODUCING SAME AND IMAGE FORMING DEVICE

(75) Inventors: Toshiki Nanya, Mishima (JP); Masami Tomita, Numazu (JP); Shigeru Emoto, Numazu (JP); Hiroshi Yamada, Numazu (JP); Shinichiro Yagi, Numazu (JP); Naohiro Watanabe, Sunto-gun (JP); Tadao Takigawa, Shinshiro (JP)

(73) Assignee: Ricoh Company, Ltd., Tokyo (JP)

( * ) Notice: Subject to any disclaimer, the term of this patent is extended or adjusted under 35 U.S.C. 154(b) by 103 days.

This patent is subject to a terminal disclaimer.

(21) Appl. No.: 10/394,265

(22) Filed: Mar. 24, 2003

(65) Prior Publication Data

US 2003/0180644 A1 Sep. 25, 2003

(30) Foreign Application Priority Data

Mar. 22, 2002 (JP) ..... 2002-080997

(51) Int. Cl.[7] ..... G03G 9/08

(52) U.S. Cl. ..... 430/108.22; 430/108.1; 430/109.4

(58) Field of Search ..... 430/108.22, 108.1, 430/109.4

(56) References Cited

U.S. PATENT DOCUMENTS

| | | | | |
|---|---|---|---|---|
| 4,900,647 | A | 2/1990 | Hikake et al. | |
| 5,215,845 | A | 6/1993 | Yusa et al. | |
| 5,296,324 | A | 3/1994 | Akagi et al. | |
| 5,476,744 | A | 12/1995 | Anno | |
| 5,792,583 | A | 8/1998 | Sano et al. | |
| 6,103,441 | A | 8/2000 | Tomita et al. | |
| 6,221,549 | B1 | 4/2001 | Emoto et al. | |
| 6,363,229 | B1 | 3/2002 | Shiraishi et al. | |
| 6,395,443 | B2 | 5/2002 | Kuroda et al. | |
| 2003/0138717 | A1 * | 7/2003 | Yagi et al. | 430/108.22 |

FOREIGN PATENT DOCUMENTS

| | | |
|---|---|---|
| EP | 0 256 136 | 2/1988 |
| EP | 0 535 246 | 4/1993 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner for developing an electrostatic image, including a colorant, a binder resin comprising a modified polyester, and fine resin particles having a weight average particle diameter of 50 to 300 nm and being present on an outer surface of the toner, wherein the toner has a BET specific surface area of 1.5 to 4.0 $m^2/g$.

18 Claims, No Drawings

TONER, METHOD OF PRODUCING SAME AND IMAGE FORMING DEVICE

BACKGROUND OF THE INVENTION

The present invention relates to a toner for developing an electrostatic image in an image forming method such as electrophotography, electrostatic recording or electrostatic printing. The present invention is also directed to a developer containing the above toner, to a container containing the developer, to an image forming apparatus having the container and to an image forming method using the above toner.

In an image forming method such as electrophotography, electrostatic recording or electrostatic printing, an electrostatic latent image formed on an image carrier such as a photoconductor is developed by a toner in a developing step. The toner image thus obtained is then transferred from the photoconductor to a transfer medium such as a transfer paper in a transfer step, and fixed on the paper in a fixing step.

The toner contains a colorant, a binder resin and one or more additives such as a charge controlling agent and a wax and is generally produced by a grinding method or a suspension polymerization method. In the grinding method, a blend of the raw material ingredients of the toner is kneaded with a kneader. The kneaded mixture is then cooled, ground and classified. From the standpoint of economy, the raw materials of the toner should be so selected as to provide an easily pulverizable composition in order to permit the of a general pulverizer. In this case, however, the toner particles thus produced have widely distributed particle sizes. In order to obtain a toner capable forming images having high resolution and gradation, therefore, it is necessary to remove coarse particles such as those having particle diameters of 20 $\mu$m or more and fine particles such as those having particle diameters of 5 $\mu$m or less. As a result, the yield of the toner is unavoidably low. The grinding method has an additional problem, because it is difficult to disperse the colorant and other additives uniformly in the binder resin. Non-uniform distribution of such ingredients adversely affects the fluidity, developing efficiency, durability and image quality of the toner.

To cope with the problems of the above grinding method, the suspension polymerization method has been proposed and is actually practiced. However, toners obtained by the suspension polymerization method are spherical and are difficult to be removed from surfaces of photoconductors. Thus, residual toners remaining on a surface of a photoconductor after the transfer of a developed toner image from the photoconductor to a transfer medium are apt to be retained thereon even after cleaning with cleaning rollers or brushes. The unremoved toner on the photoconductor will cause background stains of images. Further, the unremoved toner will be transferred to a charging roller which is in rolling contact with the photoconductor and will adversely affect the charging performance thereof.

Japanese Patent No. JP-B-2537503 discloses a non-spherical toner in the form of aggregates of secondary particles each of which is composed of fine primary particles of a resin and fine particles of a colorant. The primary resin particles are prepared by emulsion polymerization. While this toner may permit easier cleaning from a photoconductor surface as compared with a spherical toner, a surfactant used during the formation of the primary particles is apt to remain unremoved from the aggregates and pollute the photoconductor, charging roller, developing roller, etc. Further, a releasing agent such as a wax is confined within the aggregate, the desired resistance to offset is not obtainable. Additionally, since the fine particles constituting the secondary particles are not distributed uniformly in the secondary particles, there is a variation in surface characteristics between respective toner particles formed of the secondary particles, so that it is not possible to form uniform images for a long period of time.

Japanese laid-open patent publication No. JP-A-2000-292978 discloses a toner having a core-shell structure in which core particles, each containing a low molecular weight resin and a colorant, are each surrounded by particles of a high molecular weight resin. The high molecular weight resin particles, which form a shell, are fuse-bonded to the core. The presence of the high molecular weight resin particles on outer surfaces of the toner can improve resistance to offset. This toner, however, has a problem, because the fixation of toner images cannot be carried out at a low temperature.

SUMMARY OF THE INVENTION

It is, therefore, an object of the present invention to provide a toner which permits easy removal from photoconductor surfaces in a cleaning step, which permits a low temperature fixation of toner images and which shows good offset resistance.

Another object of the present invention is to provide a toner which can be uniformly charged and which can afford clear images with sharp edges for a long period of service.

In accordance with one aspect of the present invention there is provided a toner for developing an electrostatic image, comprising:

a colorant, a binder resin comprising a modified polyester, and fine resin particles having a weight average particle diameter of 50 to 300 nm, a part of said fine resin particles being present on an outer surface of said toner with the other part thereof being present within said toner, said toner having a BET specific surface area of 1.5 to 4.0 $m^2/g$.

Because of the presence of the fine resin particles with the specific size, the toner of the present invention is less spherical as compared with the conventional toner produced by emulsion polymerization and yet can contact closely with an image recording medium such as paper. Further, a releasing agent, when contained, can easily exude from the toner particles. Moreover, the toner particles have uniform composition. Therefore, the toner can be easily removed from photoconductor surfaces, allows for a low temperature fixation and exhibits good offset resistance. Further, the toner can be uniformly charged, can afford clear images for a long period of service and can show good storage stability and preservability.

In another aspect, the present invention provides a developer containing the above toner. The present invention also provides a container containing the above developer. The present invention further provides an image forming apparatus having the above container. The present invention further provides an image forming method comprising developing an electrostatic image on a photoconductor with the above toner, cleaning the photoconductor by removing a residual toner on the photoconductor, and recycling the removed toner to the developing step.

The present invention further provides a method of producing a toner, comprising the steps of:

dispersing a toner composition, which is in the form of an organic dispersion or solution and which comprises an organic solvent, a colorant, an active hydrogen-containing compound and a modified polyester prepolymer reactable with said active hydrogen-containing compound, in an aqueous medium containing fine resin particles having a weight average particle diameter of 50 to 300 nm to obtain an aqueous dispersion;

reacting said prepolymer with said active hydrogen-containing compound to obtain a modified polyester so that said aqueous dispersion contains toner particles dispersed in said aqueous medium and comprising said modified polyester, and said colorant; and removing the organic solvent and water from said dispersion such that part of said fine resin particles are present on outer surfaces of the toner particles.

The fine resin particles contained in the aqueous phase deposit on the organic particles dispersed therein and serves to control the particle distribution and sphericity of the organic particles. Thus, the toner particles obtained have so sharp and narrow particle size distribution that it is not necessary to conduct classification. Further, since very fine toner particles having a particle diameter of less than 2 $\mu$m do not exist, the toner can be easily removed from surfaces of the photoconductor by cleaning with, for example, a cleaning blade.

Other objects, features and advantages of the present invention will become apparent from the detailed description of the preferred embodiments of the invention to follow.

DETAILED DESCRIPTION OF THE PREFERRED EMBODIMENTS OF THE INVENTION

The toner according to the present invention comprises a colorant, a binder resin, and fine resin particles. It is important that the fine resin particles should have a weight average particle diameter of 50 to 300 nm and should be present on outer surfaces of the toner. It is also important that the BET specific surface area of the toner should be in the range of 1.5 to 4.0 $m^2/g$.

When the weight average particle diameter of the fine resin particles is less than 50 nm, the fine resin particles form a dense layer, like a film, covering outer surfaces of the toner particles to prevent direct contact of the binder resin of the toner with a recording medium such as paper and to adversely affect the low temperature fixation. In addition, the fine resin particles prevent wax contained in the toner from exuding to adversely affect offset resistance. When the weight average particle diameter of the fine resin particles is greater than 300 nm, on the other hand, the binder resin of the toner is also prevented from closely contacting with the image recording medium. Further, the wax is prevented from exuding easily from the toner particles. For the same reasons, the BET specific surface area should be in the range of 1.5 to 4.0 $m^2/g$.

The weight average particle diameter of the fine resin particles is measured by laser beam scattering method. Particle size distribution measuring device LA-920 (manufactured by Horiba Seisakusho Co., Ltd.) is suitably used for the measurement of the average particle diameter. The BET specific surface area is measured by the BET multi-point method in which nitrogen is adsorbed on a sample. A specific surface area meter (Autosorb 1 manufactured by Yuasa Ionics Co., Ltd.) is suitably used.

It is preferred that the fine resin particles be present on outer surfaces of the toner particles in an amount of 0.5 to 5% by weight, more preferably 0.8 to 2.5% by weight, based on a total weight of the toner (based on a total weight of the toner particles and the fine resin particles) for reasons of improved preservability (prevention of blocking during storage) and offset resistance. The amount of the fine resin particles is measured by a standard addition method using gas chromatography and mass spectrometry.

The toner of the present invention-preferably has average sphericity of 0.96 to 0.90, more preferably 0.955 to 0.940, for reasons of obtaining fine images with good image density and high reproducibility as well as desired removability of residual toners from photoconductor surfaces. It is particularly preferred that the amount of the toner particles having sphericity of less than 0.94 be 15% by number or less.

It is also preferred that the toner have a volume average particle diameter Dv of 4 to 8 $\mu$m and a number average particle diameter Dn providing a ratio Dv/Dn of the volume average particle diameter to the number average particle diameter of 1.25 or less, more preferably from 1.10 to 1.25. When the above particle size characteristics are met, the toner can exhibit excellent heat resisting preservability, low temperature fixation efficiency and resistance to hot-offset and can give color images with high gloss. Further, irrespective of whether the toner is used as a two-component developer or a one-component developer, a variation of the particle size of the toner is minimized so that stable image development can be achieved for a long period of time even subjected to repeated agitation and replenishment. Additionally, deposition of the toner to a carrier, a developing roller, a thickness regulating blade and a photoconductor (toner filming) can be prevented to a satisfactory degree. While a small particle size is desirable from the standpoint of image quality, excessively small particle size causes toner filming.

When the volume average particle diameter is excessively small, the toner is apt to be fused and to deposit on carrier particles during a long period of use in the case of a two-component developer. Such deposits adversely affect the charging characteristics of the carrier. In the case of a single-component developer, the toner having excessively small volume average particle diameter Dv is apt to cause formation of toner filming on a developing roller, a regulating blade or the like member during a long period of service. When the volume average particle diameter Dv is excessively great, it is difficult to obtain toner images having high resolution and high quality. Additionally, the toner shows a significant variation in particle size during a long period of service with occasional replenishment thereof. These disadvantages are apt to be caused when the ratio Dv/Dn of the volume average particle diameter to the number average particle diameter is excessively large. When the Dv/Dn is excessively small, on the other hand, it becomes difficult to sufficiently charge the toner. In addition, cleaning of a surface of a latent image bearable member such as a photoconductor for the removal of the toner remaining thereon is not easy.

The binder resin of the toner according to the present invention comprises a modified polyester.

The modified polyester as used herein is intended to refer to a polyester to which one or more groups or polymer components (other than ester groups and those originally contained in the alcohol or carboxylic acid monomer units of the polyester) are bonded (through ionic bonding or covalent bonding) or added.

The modified polyester may be preferably obtained by reacting a modified polyester prepolymer with an active hydrogen-containing compound. The modified polyester prepolymer is preferably an isocyanate group-containing polyester prepolymer. The polyester prepolymer containing an isocyanate group may be obtained by reacting a polyisocyanate with a polyester which is prepared by polycondensation of a polyol with a polyacid and which has an active hydrogen. Examples of active hydrogen-containing groups include a hydroxyl group (alcoholic OH or phenolic OH), an amino group, a carboxyl group and a mercapto group. Among these active hydrogen-containing groups, alcoholic OH is preferred.

The polyol may be a diol or a tri- or more polyhydric alcohol. A mixture of a diol with a minor amount of a tri- or more polyhydric alcohol is preferably used.

As the diol to be used for the preparation of the base polyester, any diol employed conventionally for the preparation of polyester resins can be employed. Preferred examples include alkylene glycols such as ethylene glycol, 1,2-propylene glycol, 1,3-propylene glycol, 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol; alkyleneether glycols such as diethylene glycol, triethylene glycol, dipropylene glycol, polyethylene glycol, polypropylene glycol and polytetramethylene ether glycol; alicyclic glycols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2 to 12 carbon atoms and alkylene oxide adducts of bisphenols are preferred. Especially preferred is the use of a mixture of alkylene glycols having 2 to 12 carbon atoms with alkylene oxide adducts of bisphenols.

Examples of the polyol having three or more hydroxyl groups include polyhydric aliphatic alcohols such as glycerin, 2-methylpropane triol, trimethylolpropane, trimethylolethane, pentaerythritol, sorbitol and sorbitan; phenol compounds having 3 or more hydroxyl groups such as trisphenol PA, phenol novolak and cresol novolak; and alkylene oxide adducts of the phenol compounds having 3 or more hydroxyl groups.

The polyacid may be a dicarboxylic acid, tri- or more polybasic carboxylic acid or a mixture thereof.

As the dicarboxylic acid to be used for the preparation of the base polyester, any dicarboxylic acid conventionally used for the preparation of a polyester resin can be employed. Preferred examples include alkyldicarboxylic acids such as malonic acid, succinic acid, glutaric acid, adipic acid, azelaic acid and sebacic acid; alkenylene dicarboxylic acids such as maleic acid, fumaric acid, citraconic acid and itaconic acid; and aromatic dicarboxylic acids such as phthalic acid, terephthalic acid, isophthalic acid and naphthalene dicarboxylic acid. Above all, alkenylene dicarboxylic acids having 4 to 20 carbon atoms and aromatic dicarboxylic acids having 8 to 20 carbon atoms are preferably used.

Examples of tri- or more polybasic carboxylic acids include aromatic polybasic carboxylic acids having 9 to 20 carbon atoms such as trimellitic acid and pyromellitic acid.

The polyacids may be in the form of anhydrides or low alkyl esters (e.g. methyl esters, ethyl esters and isopropyl esters).

In the formation of the polyester, the polyacids and the polyols are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Examples of the polyisocyanate compound reacted with the polyester include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as xylylene diisocyanate, tolylene diisocyanate, diphenylmethane diisocyanate and $\alpha,\alpha,\alpha'$, $\alpha'$-tetramethylxylylene diisocyanate; isocyanurates; the above polyisocyanates blocked or protected with phenol derivatives, oximes or caprolactams; and mixtures thereof.

The polyisocyanate is used in such an amount that the ratio [NCO]/[OH] of the equivalent of the isocyanate groups [NCO] to the equivalent of the hydroxyl groups [OH] of the polyester is in the range of generally 5:1 to 1:1, preferably 4:1 to 1.2:1, more preferably 2.5:1 to 1.5:1. A [NCO]/[OH] ratio of over 5:1 tends to adversely affect low-temperature fixation efficiency of the resulting toner. Too small a [NCO]/[OH] ratio of less than 1 tends to adversely affect anti-hot offset properties of the resulting toner.

The isocyanate group-containing polyester prepolymer generally has a content of the polyisocyate unit in the range of 0.5 to 40% by weight, preferably 1 to 30% by weight, more preferably 2 to 20% by weight. Too small an isocyanate group content of less than 0.5% tends to adversely affect anti-hot offset properties and to pose a difficulty in simultaneously obtaining satisfactory low-temperature fixation efficiency and heat-resisting preservability of the resulting toner. When the isocyanate group content exceeds 40% by weight, the low-temperature fixation efficiency of the resulting toner tends to be adversely affected.

The average number of the isocyanate groups contained in the prepolymer molecule is generally at least 1, preferably 1.5 to 3, more preferably 1.8 to 2.5. Too small a isocyanate group number less than 1 will result in a modified polyester (obtained by the reaction with the active hydrogen-containing compound) having an excessively small molecular weight so that the anti-hot offset properties of the toner will be adversely affected.

The active hydrogen-containing compound to be reacted with the isocyanate group-containing polyester prepolymer is preferably an amine. Examples of the amine include diamines, polyamines having 3 or more amino groups, aminoalcohols, aminomercaptans, amino acids and blocked or protected derivatives thereof.

Illustrative of suitable diamines are aromatic diamines such as phenylenediamine, diethytoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable polyamines having 3 or more amino groups are diethylenetriamine and triethylenetetramine. Illustrative of suitable aminoalcohols are ethanolamine and hydroxyethylaniline. Illustrative of suitable aminomercaptans are aminoethylmercaptan and aminopropylmercaptan. Illustrative of suitable amino acids are aminopropionic acid and aminocaproic acid. Illustrative of suitable blocked derivatives of the above diamines, polyamines having 3 or more amino groups, aminoalcohols, aminomercaptans and amino acids are ketimines obtained by interacting the amines with a ketone such as acetone, methyl ethyl ketone or methyl isobutyl ketone. Oxazolidine compounds may be also used as the blocked derivatives. Especially preferred amine is an aromatic diamine or a mixture of an aromatic diamine with a minor amount of a polyamine having 3 or more amino groups.

If desired, a chain extension terminator and or a crosslinking agent may be used to control the molecular weight of the modified polyester. Examples of the chain extension terminators include monoamines such as diethylamine, dibutylamine, butylamine and laurylamine. Blocked or protected monomines such as ketimines may be also used as the terminator.

The amine is reacted with the isocyanate group-containing polyester prepolymer in such an amount that the ratio $[NCO]/[NH_x]$ of the equivalent of the isocyanate groups [NCO] of the prepolymer to the equivalent of the amino groups $[NH_x]$ of the amine is in the range of generally 1:2 to 2:1, preferably 1.5:1 to 1:1.5, more preferably 1.2:1 to 1:1.2. A $[NCO]/[NH_x]$ ratio over 2:1 or less than 1:2 will result in a urea-modified polyester having an excessively small molecular weight so that the anti-hot offset properties of the toner will be adversely affected.

One specific example of a method of producing the modified polyester is as follows. A polyol and a polyacid are reacted with each other in the presence of an esterification catalyst such as tetrabutoxytitanate or dibutyltin oxide at a temperature of 150 to 280° C. The reaction may be carried out under a reduced pressure while removing water produced in situ, if desired. The resulting hydroxyl group-containing polyester is reacted with a polyisocyanate at 40 to 140° C. in the presence or absence of a solvent to obtain an isocyanate-containing polyester prepolymer. The polyester prepolymer is reacted with an amine (active hydrogen-containing compound) at 0 to 140° C. in the presence or absence of a solvent to obtain a urea-modified polyester. Any solvent inert to the polyisocyanate may be used. Examples of the solvents include aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

It is preferred that the modified polyester be used in conjunction with an unmodified polyester as the toner binder for reasons of improved low-temperature fixation efficiency of the toner and improved gloss of the toner images. The unmodified polyester may be polycondensation products obtained from polyols and polyacids. Suitable polyols and polyacids are as described previously with reference to the modified polyester. For reasons of improved low-temperature fixation efficiency, it is preferred that the modified polyester and the unmodified polyester be compatible at least in part with each other. The amount of the unmodified polyester in the toner binder is such that the weight ratio of the modified polyester to the unmodified polyester is generally 5:95 to 75:25, preferably 10:90 to 25:75, more preferably 12:88 to 25:75, most preferably 12:88 to 22:78. Too small an amount of the modified polyester below 5% by weight is not advantageous because the anti-hot offset properties are deteriorated and because it is difficult to attain both heat resistive preservability and low-temperature fixation efficiency simultaneously.

The unmodified polyester generally has a peak molecular weight of 1,000 to 30,000, preferably 1,500 to 10,000, more preferably 2,000 to 8,000, for reasons of ensuring satisfactory heat-resistant preservability and low-temperature fixation efficiency. The term "peak molecular weight" as used herein is intended to refer to the molecular weight at which the main peak is present in the molecular weight distribution thereof when measured by gel permeation chromatography.

The unmodified polyester preferably has a hydroxy value of at least 5, more preferably 10–120, most preferably 20–80 for reasons of simultaneous attainment of both good heat resistive preservability and low-temperature fixation efficiency of the toner and freedom of susceptibility to influence by temperature and humidity. The unmodified polyester generally has an acid value of 0.5 to 40 mg KOH, preferably 5 to 35 mg KOH for reasons of desired chargeability and freedom of susceptibility to influence by temperature and humidity.

The binder resin used in the present invention preferably has a glass transition point of 40 to 70° C., more preferably 40 to 50° C. for reasons of good heat resistive preservability and good low-temperature fixation efficiency. Because of the presence of the modified polyester, the toner of the present invention exhibits superior heat resistance and preservability even though the glass transition point of the toner is low.

The toner binder preferably has an acid value of 0.5 to 40 mg KOH for reasons of improved compatibility between the toner and paper and improved fixing efficiency.

If desired, a modified polyester other than a urea-modified polyester, such as an urethane-modified polyester, may be incorporated into the binder resin.

As the colorant usable for the electrostatic image developing toner of the present invention, any colorant known to be used conventionally for the preparation of a toner can be employed. Suitable colorants for use in the toner of the present invention include known pigments and dyes. These pigments and dyes can be used alone or in combination.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG)-, Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination.

The content of a coloring agent in the toner of the present invention is preferably from about 1 to 15% by weight, more preferably 3–10% by weight, based on the weight of the toner.

In one embodiment of the production of toner, the colorant is composited with a resin binder to form a master batch.

As the binder resin for forming the master batch, the above-described modified polyester, unmodified polyester may be used. Further, various other polymers may also be used for the formation of the master batch. Specific examples of such other polymers for use in the formation of the master batch include homopolymers of styrene or substituted styrenes such as polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylethyl ether copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These polymers can be used alone or in combination.

The master batch may be obtained by mixing and kneading the binder resin and the colorant while applying a large shear strength thereto using a suitable kneader such as a three-roller mill. In this case, an organic solvent may be used to enhance the interaction between the resin and the colorant. If desired, "flushing" method may be adopted to obtain the master batch. In this method, an aqueous paste containing a colorant is mixed and kneaded together with a binder resin and an organic solvent so that the colorant migrates to the organic phase. The organic solvent and water are then removed.

The toner of the present invention preferably contains a wax as a releasing agent in addition to the toner binder and the colorant. The wax preferably has a melting point of 40 to 160° C., preferably 50 to 120° C., more preferably 60 to 90° C. A melting point of the wax below 40° C. may adversely affect the heat resistance and preservability of the toner, while too high a melting point in excess of 160° C. is apt to cause cold offset of toner when the fixation is performed at a low temperature. Preferably, the wax has a melt viscosity of 5 to 1000 cps, more preferably 10 to 100 cps, at a temperature higher by 20° C. than the melting point thereof. When the viscosity is greater than 1000 cps, the anti-hot offset properties and low fixation efficiency of the toner are adversely affected.

Any wax may be suitably used for the purpose of the present invention. Examples of such wax include polyolefin wax, such as polyethylene wax and polypropylene wax; long chain hydrocarbon wax, such as paraffin wax and sazole wax; and carbonyl group-containing wax.

The carbonyl group-containing wax is preferably used for the purpose of the present invention. Illustrative of suitable carbonyl group-containing waxes are polyalkanoic acid ester waxes such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol ester waxes such as tristearyl trimellitate and distearyl maleate; polyalkanoic acid amide waxes such as ethylenediamine dibehenyl amide; polyalkylamide waxes such as trimellitic acid tristearyl amide; and dialkyl ketone waxes such as distearyl ketone. Above all, the use of a polyalkanoic acid ester wax is preferred.

The amount of the wax in the toner is generally 0 to 40% by weight, preferably 3 to 30% by weight, based on the weight of the toner. The wax may be mixed and kneaded with the binder resin or the above master batch.

The toner of the present invention may contain a charge controlling agent, if desired. Any charge controlling agent generally used in the field of toners for use in electrophotography may be used for the purpose of the present invention. Examples of such charge controlling agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metallic salts of salicylic acid and derivatives thereof.

Specific examples of the charge controlling agents include Bontron 03 (Nigrosine dyes), Bontron P-51 (Quaternary ammonium salts), Bontron S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; Copy Charge PSY VP2038 (quaternary ammonium salts)' Copy Blue PR (triphenylmethane derivatives), Copy Charge NEG VP2036 (quaternary ammonium salts) and Copy Charge NX VP434(quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

The amount of charge control agent for use in the color toner may be determined in light of the kind of binder resin to be employed, the presence or absence of additives, and the preparation method of the toner including the method of dispersing the composition of the toner. It is preferable that the amount of charge control agent be in the range of 0.1 to 10 parts by weight, and more preferably in the range of 0.2 to 5 parts by weight, per 100 parts by weight of the binder resin. By the addition of the charge control agent in such an amount, sufficient chargeability for use in practice can be imparted to the toner. Further, electrostatic attraction of the toner to a developing roller can be prevented, so that the decrease of fluidity of the developer and the decrease of image density can be prevented. The charge controlling agent may be mixed and kneaded with the binder resin or the above master batch. If desired, the charge controlling agent may be adhered to toner particles.

The toner according to the present invention has outer surface on which fine resin particles having a weight average particle diameter of 50 to 300 nm are present. Any thermoplastic or thermosetting resin may be used as a material of the fine resin particles as long as it permits the formation of aqueous dispersion when dispersed in an aqueous medium. Examples of the resin of the fine resin particles include a vinyl resin, a polyurethane resin, an epoxy resin, a polyester resin, a polyamide resin, a polyimide resin, a silicone resin, a phenol resin, a melamine resin, an urea resin, an aniline resin, an ionomer resin, a polycarbonate resin and mixtures of two or more thereof. For reasons of easiness in obtaining an aqueous dispersion of fine resin particles, the use of a vinyl resin, a polyurethane resin, an epoxy resin, a polyester resin or a mixture of two or more thereof is preferred. These resins may be homopolymers or copolymers. Illustrative of suitable vinyl resins are styrene-acrylic acid copolymers, styrene-methacrylic acid copolymers, styrene-butadiene copolymers, acrylic acid-acrylate copolymers, methacrylic acid-acrylate copolymers, styrene-acrylonitrile copolymers, styrene-maleic anhydride copolymers, styrene-methacrylate copolymers and styrene-acrylate copolymers.

The resin fine particles permits the toner to be used for an image forming method using a nagatively chargeable toner. Without the resin fine particles, the toner tends to be positively chargeable because of the presence of terminal amino groups of the modified polyester binder.

Inorganic fine particles may be suitably used, as an external additive, to improve the fluidity, developing efficiency and chargeability of the toner by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 0.005 $\mu$m to 2 $\mu$m, more preferably 0.005 $\mu$m to 0.5 $\mu$m, and a BET specific surface area of 20 to 500 m/g. The inorganic fine particles are used in an amount of generally 0.01 to 5% by weight, preferably 0.01 to 2% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents, silicone oil and modified silicone oil.

Cleaning property improving agents may be also used in the toner of the present invention for facilitating the removal of toner remaining on a photoconductor or an intermediate transfer medium after the transference. Examples of such cleaning property improving agents include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The particulate polymer preferably has a volume average particle diameter of 0.01 to 1 $\mu$m.

In one preferable method of preparing the toner according to the present invention, a toner composition, which is in the form of an organic dispersion or solution and which comprises an organic solvent, a colorant, an active hydrogen-containing compound and a modified polyester prepolymer reactable with the active hydrogen-containing compound, is dispersed in an aqueous medium containing fine resin particles having a weight average particle diameter of 50 to 300 nm to obtain an aqueous dispersion.

The colorant, active hydrogen-containing compound, modified polyester prepolymer and fine resin particles are already described above. The toner composition may further include unmodified polyester and other suitable additives such as a releasing agent (wax) and a charge controlling agent which are also described above.

The organic solvent in the toner composition may be, for example, an aromatic solvent such as toluene or xylene; a ketone such as acetone, methyl ethyl ketone or methyl isobutyl ketone; an ester such as ethyl acetate; an amide such as dimethylformamide or dimethylacetamide; or an ether such as tetrahydrofuran. A mixture of the above solvents may also be suitably used.

The prepolymer in the aqueous dispersion is then reacted with the active hydrogen-containing compound to obtain a modified polyester so that the aqueous dispersion contains toner particles dispersed in the aqueous medium and including the modified polyester, colorant and other optional ingredients.

The organic solvent and water are subsequently removed from the aqueous dispersion to obtain toner particles having a part of the fine resin particles present on outer surfaces thereof.

The aqueous medium used in the dispersion method may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

The prepolymer is converted into the modified polyester in the aqueous medium by reaction with the active hydrogen-containing compound which may serve as a chain extender and/or a crosslinking agent. The reaction may be performed at a temperature of 0 to 150° C. (under a pressurized condition), preferably 40 to 98° C., for 10 minutes to 40 hours, preferably 2 to 24 hours in the presence of, if desired, a catalyst such as dibutyltin laurate or dioctyltin laurate.

It is preferred that other ingredients, such as the colorant, colorant master batch, wax, charge controlling agent and unmodified polyester, than the modified polyester prepolymer be previously mixed with the modified polyester prepolymer in an organic solvent. However, at least one of such ingredients may be added to the aqueous medium at the time of dispersing the organic solvent solution or dispersion of the modified polyester prepolymer into the aqueous medium or after the formation of toner particles dispersed in the aqueous medium, if desired. For example, the colorant may be incorporated into the toner by a suitable known method after the toner particles containing the wax, the binder, etc. have been prepared.

Dispersion into the aqueous phase may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2 to 20 μm in a facilitated manner. The high speed shearing type dispersing device is generally operated at a revolution speed of 1,000 to 30,000 rpm, preferably 5,000 to 20,000 rpm. The dispersing time is generally 0.1 to 5 minutes in the case of a batch type dispersing device. The dispersing step is generally performed at 0 to 150° C. (under a pressurized condition), preferably 40 to 98° C. A higher temperature is suitably used to decrease the viscosity of the mass.

The aqueous medium is generally used in an amount of 50 to 2,000 parts by weight, preferably 100 to 1,000 parts by weight per 100 parts by weight of the toner composition containing the modified polyesterprepolymer and other ingredients for reasons of obtaining suitable dispersion state.

A dispersing agent may be used in dispersing the toner composition into the aqueous medium to stabilize the dispersion and to obtain sharp particle size distribution. Examples of the dispersing agent include anionic surface active agents such as a salt of alkylbenzensulfonic acid, a salt of α-olefinsulfonic acid and a phosphoric ester; cationic surface active agents such as amine surfactants (e.g. an alkylamine salt, an aminoalcohol fatty acid derivative, a polyamine fatty acid derivative and imidazoline), and quaternary ammonium salt surfactants (alkyl trimethylammonium salt, dialkyl dimethylammonium salt, alkyl dimethylammonium salt, pyridium salt, alkyl isoquinolinium salt and benzethonium chloride; nonthe modified polyester (or a prepolymer thereof) the modified polyester (or a prepolymer thereof); nonionic surface active agent such as a fatty amide derivative and polyhydric alcohol derivative; and ampholytic surface active agents such as alanine, dodecyl di(aminoethyl)glycine and di(octylaminoethyl)glycine and N-alkyl-N,N-dimethylammoniumbetaine.

A surfactant having a fluoroalkyl group can exert its effects in an only very small amount and is preferably used. Suitable anionic surfactants having a fluoroalkyl group include fluoroalkylcarboxylic acids having 2 to 10 carbon atoms and their metal salts, perfluorooctanesulfonylglutamic acid disodium salt, 3-[omega-fluoroalkyl($C_6$–$C_{11}$)oxy]-1-alkyl ($C_3$–$C_4$) sulfonic acid sodium salts, 3-[omega-fluoroalkanoyl($C_6$–$C_8$)-N-ethylamino]-1-propanesulfonic acid sodium salts, fluoroalkyl($C_{11}$–$C_{20}$)carboxylic acids and their metal salts, perfluoroalkyl($C_7$–$C_{13}$)carboxylic acids and their metal salts, perfluoroalkyl($C_4$–$C_{12}$)sulfonic acid and their metal salts, perfluorooctanesulfonic acid diethanolamide, N-propyl-N-(2-hydroxyethyl) perfluorooctanesulfonamide, perfluoroalkyl($C_6$–$C_{10}$) sulfoneamidopropyl trimethylammonium salts, perfluoroalkyl ($C_6$–$C_{10}$)-N-ethylsulfonylglycine salts, and monoperfluoroalkyl($C_6$–$C_{16}$)ethylphosphoric acid esters.

Examples of tradenames of anionic surfactants having a perfluoroalkyl group include Surflon S-111, S-112 and S-113 (manufactured by Asahi Glass Co., Ltd.), Florard FC-93, Ec95, FC-98 and FC-129 (manufactured by Sumitomo 3M Ltd.), Unidine DS-101 and DS-102 (manufactured by Daikin Co., Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos co., Ltd.).

Examples of suitable cationic surfactants having a fluoroalkyl group include primary, secondary or tertiary aliphatic amine salts; aliphatic quaternary ammonium salts such as perfluoroalkyl($C_6$–$C_{10}$) sulfonamidopropyltrimethyl-ammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Co.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

In addition, dispersants of inorganic compounds, which are hardly soluble in water, such as tricalcium phosphate, calcium carbonate, titanium oxide, colloidal silica, and hydroxyapatite can also be employed.

In addition, dispersed particles can be stabilized with polymer type protective colloids. Specific examples of such polymer type protective colloids include homopolymers and copolymers of the following compounds:

acids such as acrylic acid, methacrylic acid, α-cyanoacrylic acid, α-cyanomethacrylic acid, itaconic acid, crotonic acid, fumaric acid, maleic acid, and maleic anhydride;

(meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide;

vinyl alcohol, ethers such as vinyl methyl ether, vinyl ethyl ether and vinyl propyl ether;

esters of vinyl alcohol with a carboxylic acid such as vinylacetate, vinylpropionate and vinyl butyrate;

amides such as acrylamide, methacrylamide, diacetoneacrylamide, and their methylol compounds;

acid chloride compounds such as acrylic acid chloride, and methacrylic acid chloride;

homopolymers and copolymers of compounds having a nitrogen atom or a heterocyclic ring including a nitrogen atom such as vinyl pyridine, vinyl pyrrolidone, vinyl imidazole and ethylene imine;

polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds such as methyl cellulose, hydroxyethyl cellulose, and hydroxypropyl cellulose.

For the purpose of reducing the viscosity of the toner composition in the organic solvent dispersion and the aqueous dispersion, an organic solvent capable of dissolving the modified polyester prepolymer or modified polyester obtained therefrom may be used. As the organic solvents, there may be mentioned aromatic hydrocarbons such as toluene, xylene and benzene; halogenated hydrocarbons such as carbon tetrachloride, methylene chloride, 1,2-dichloroethane, 1,1,2-trichloroethane, trichloroethylene, chloroform, monochlorobenzene and dichlorloethylidene; esters such as methyl acetate and ethyl acetate; and ketones such as methyl ethyl ketone and methyl isobutyl ketone. These solvents may be used singly or in combination. The use of a solvent having a boiling point of less than 100° C. is preferred for reasons of easiness in removing in the subsequent step. Toluene, xylene, methylene chloride, 1,2-dichloroethane, chloroform and carbon tetrachloride are illustrative of suitable solvent. The amount of the organic solvent is generally 0 to 300 parts by weight, preferably 0 to 100 parts by weight, more preferably 25 to 7b parts by weight, per 100 parts by weight of the modified polyester (or a prepolymer thereof). The use of the solvent can produce toner particles having a narrow particle size distribution.

The dispersion or emulsion of toner particles in the aqueous medium thus prepared is then treated to remove the organic solvent and water. The removal of the solvent can be carried out by gradually heating the dispersion to evaporate the organic solvent and also water to dryness. Alternatively, the dispersion is sprayed into a dry atmosphere to evaporate the organic solvent to obtain fine toner particles which are then dried to remove water. The dry atmosphere may be a gas, such as air, nitrogen, carbon dioxide, combustion gas, which is heated above the boiling point of the organic solvent used. A spray drier, a belt drier or a rotary kiln may be used for separating and drying the toner particles.

When a dispersing agent capable of being dissolved in an acid or an alkali is used, washing with an acid or alkali and then with water can remove the dispersing agent from the toner particles. For example, calcium phosphate may be removed by washing with an acid such as hydrochloric acid and then with water. An enzyme may be also used to remove certain kinds of the dispersing agent. Although the dispersing agent can be retained on the toner particles, the removal thereof is preferable for reasons of charging characteristics of the toner.

When the toner particles in the dispersion obtained have a wide particle size distribution, classification may be conducted. The classification for the removal of excessively fine particles is preferably carried out before separation of the toner particles from the dispersion for reasons of efficiency, though the classification may be preceded by the separation and drying of the particles. Classification for the removal of fine particles may be performed using, for example, a cyclone, a decanter or a centrifugal device. Air classification may be suitably adopted for the removal of large particles after drying of the toner particles. Large and small particles thus separated may be reused as raw materials for the preparation of the toner.

The thus obtained toner particles can be mixed with different types of particles such as a particulate release agent, a particulate charge controlling agent, a particulate fluidizing agent and a particulate colorant. By applying mechanical force to the mixture, these different particles can be fixed and unified with the surface of the toner particles and thereby the different particles are prevented from releasing from the resultant complex particles. Methods useful for applying mechanical force include impacting the mixture rapidly-rotating blades; and discharging the mixture into a high speed airflow so that the particles of the mixture accelerate and collide with each other or the particles impact against a proper plate or some such object. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

The toner according to the present invention can be used as a two-component developer after mixed with a carrier or as a one-component developer or microtoning developer having magnetic powders incorporated in the toner.

When the toner of the present invention is employed as a two-component developer, any conventionally-known carrier can be used. In this case, the toner is generally used in an amount of 1 to 10 parts by weight per 100 parts by weight of the carrier. Examples of the carrier include magnetic powders such as iron powders, ferrite powders, magnetite powders, magnetic resin powders and nickel powders and glass beads, and these powders having a surface treated with a resin. The magnetic toner generally has a particle diameter of 20 to 200 $\mu$m. Examples of the resin for covering the surface of the carrier include amino resins, urea-formaldehyde resins, melamine resins, benzoguanamine resins, urea resins, polyamide resins and epoxy resins. Also usable for covering carrier are polyvinyl or polyvinylidene resins; polystyrene-type resins such as acrylic resins, polymethyl methacrylate resins, polyacrylonitrile resins, polyvinyl acetate resins, polyvinyl fluoride resins; polyvinyl butyral resins, polyvinyl alcohol resins, polystyrene resins and styrene-acrylic acid copolymers; halogenated olefin resins such as polyvinyl chloride resins; polyester resins such as polyethylene terephthalate resins and polybutylene terephthalate resins; polycarbonate resins; polyethylene resins; polyvinylidene fluoride resins; polytrifluoroethylene resins; polyhesafluoropropylene resins; copolymers of vinylidene fluoride and acrylic monomer; copolymers of vinylidene fluoride and vinyl fluoride; terpolymers of tetrafluoroethylene, vinylidene fluoride and a fluorine-free monomer; and silicone resins. The resin coating for the carrier may contain conductive powder such as metal powder, carbon black, titanium oxide, tin oxide or zinc oxide. The conductive powder preferably has an average particle diameter of 1 $\mu$m or less for reasons of easy control of the electric resistance.

The toner of the present invention may be used as a one-component magnetic or nonmagnetic toner requiring no carrier.

The following examples will further illustrate the present invention. Parts are by weight.

EXAMPLE 1

Preparation of Aqueous Phase 1

<Synthesis of Fine Resin Particle Dispersion 1>

683 Parts of water, 11 parts of a sodium salt of sulfuric acid ester of ethylene oxide adduct of methacrylic acid (Eleminol RS-30, made by Sanyo Chemical Industries), 83 parts of styrene, 83 parts of methacrylic acid, 110 parts of butyl acrylate and 1 part of ammonium persulfate were charged in a reaction vessel equipped with a stirrer and a thermometer and stirred at 400 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (Fine Resin Particle Dispersion 1) of a vinyl resin (copolymer of styrene-methacrylic acid-butyl acrylate-sodium salt of sulfuric acid ester of ethylene oxide adduct of methacrylic acid). Fine Resin Particle Dispersion 1 had a volume average particle size of 100 nm when measured with LA-920. Part of Fine Resin Particle Dispersion 1 was dried to isolate the resin component.

<Preparation of Aqueous Phase 1>

990 Parts of water, 83 parts of Fine Resin Particle Dispersion 1, 37 parts of a 48.5% aqueous solution of sodium dodecyldiphenyl ether disulfonate (Eleminol MON-7, made by Sanyo Chemical Industries) and 90 parts of ethyl acetate were mixed and stirred to obtain a milky white liquid, which was designated as Aqueous Phase 1.

Preparation of Prepolymer 1

682 Parts of ethylene oxide (2 mole) adduct of bisphenol A, 81 parts of propylene oxide (2 mole) adduct of bisphenol A, 283 parts of terephthalic acid, 22 parts of trimellitic anhydride and 2 parts of dibutyltin oxide were charged in a reaction vessel equipped with a condenser, a stirrer and a nitrogen gas feed pipe and reacted at 230° C. under ambient pressure for 8 hours. The reaction was further continued under a reduced pressure of 10 to 15 mmHg for 5 hours to obtain an intermediate polyester 1 having a number average molecular weight of 2100, a weight average molecular weight of 9500, a Tg of 55° C., an acid value of 0.5 and a hydroxyl value of 51.

410 Parts of the intermediate polyester 1, 89 parts of isophorone diisocyanate and 500 parts of ethyl acetate were charged in a reaction vessel equipped with a condenser, a stirrer and a nitrogen gas feed pipe and reacted at 100° C. for 5 hours to obtain Prepolymer 1 having a free isocyanate content of 1.53% by weight.

Preparation of Ketimine 1

170 Parts of isophorone diamine and 75 parts of methyl ethyl ketone were charged in a reaction vessel equipped with a stirrer and a thermometer and reacted at 50° C. for 5 hours to obtain Ketimine 1 having an amine value of 418.

Preparation of Pigment-Wax Dispersion 1

<Synthesis of Low-molecular Weight Polyester 1>

229 Parts of an ethylene oxide (2 mole) adduct of bisphenol A, 529 parts of a propylene oxide (3 mole) adduct of bisphenol A, 208 parts of terephthalic acid, 46 parts of adipic acid and 2 parts of dibutyltin oxide were charged in a reaction vessel equipped with a condenser, a stirrer and a nitrogen gas feed pipe, and reacted at 230° C. under ambient pressure for 8 hours. The reaction was further continued for 5 hours at a reduced pressure of 10–15 mmHg. 44 Parts of trimellitic anhydride was added to the reaction vessel and the mixture was reacted at 180° C. under ambient pressure for 2 hours, thereby obtaining a low-molecular weight polyester 1 having a number average molecular weight of 2500, a weight average molecular weight of 6700, a Tg of 43° C. and an acid value of 25.

<Preparation of Master Batch 1>

1200 Parts of water, 540 parts of carbon black (Printex 35, made by Degussa Co., DBP oil absorption: 42 ml/100 mg, pH: 9.5), and 1200 parts of the low-molecular weight polyester 1 resin were mixed in a Henschel mixer (manufactured by Mitsui Mining Company, Limited). The mixture was kneaded in a double roll kneader at 150° C. for 30 minutes. The kneaded mixture was rolled and cooled, and then pulverized with a pulverizer, thereby obtaining a master batch 1.

<Preparation of Pigment-Wax Dispersion 1>

378 Parts of the low-molecular weight polyester 1, 110 parts of carnauba wax, 22 parts of CCA (salicylic acid metal complex, E-84, made by Orient Chemical Industries, Ltd.) and 947 parts of ethyl acetate were charged in a vessel equipped with a stirrer and a thermometer and heated to 80° C. with stirring. The mixture was maintained at 80° C. for 5 hours and then cooled to 30° C. in one hour. 500 Parts of the master batch 1 and 500 parts of ethyl acetate were added to the vessel and mixed for 1 hours, thereby obtaining an ingredient solution 1.

<Preparation of Pigment-Wax Dispersion 1>

1324 Parts of the ingredient solution 1 were charged in a vessel and dispersion of the carbon black and the wax was performed by passing the solution through a beads mill (Ultraviscomill, manufactured by Aimex Co., Ltd.) filled with zirconia beads having a diameter of 0.5 mm by 80 vol. % three times under conditions of a liquid feeding rate of 1 kg/hr and a disk circumferential velocity of 6 m/sec. This was then mixed with 1324 parts of a 65% ethyl acetate solution of the low-molecular weight polyester 1. The mixture was once passed through the beads mill under the same conditions as above, thereby obtaining Pigment-Wax Dispersion 1 having a solid concentration of 50% (130° C., 30 minutes).

Preparation of Toner 1

<Polymerization>

749 Parts of Pigment-Wax Dispersion 1, 115 parts of Prepolymer 1 and 2.9 parts of Ketimine 1 were charged in a vessel and mixed with TK Homomixer (manufactured by Tokushu Kika Kogyo Co., Ltd.) at 5,000 rpm for one minute. The mixture was then mixed with 1,200 parts of Aqueous Phase 1 with TK Homomixer at 13,000 rpm for 20 minutes, thereby obtaining an emulsified slurry 1.

The thus obtained emulsified slurry 1 was heated at 30° C. for 8 hours in a vessel equipped with a stirrer and a thermometer for removing part of the solvent and then aged at 45° C. for 4 hours, thereby obtaining a dispersed slurry 1 having a volume average particle diameter of 5.99 $\mu$m and a number average particle diameter of 5.70 $\mu$m (measured with Multisizer II).

<Washing and Drying>

100 Parts of the dispersed slurry 1 was filtered under a reduced pressure and then subjected to the following treatments:

(1) The filtered cake and 100 parts of ion-exchanged water were mixed with TK Homomixer (at 12,000 rpm for 10 minutes), and the mixture was filtered.

(2) The cake obtained in (1) and 100 parts of 10% hydrochloric acid were mixed with TK Homomixer (at 12,000 rpm for 30 minutes), and the mixture was filtered.

(3) The cake obtained in (2) and 300 parts of ion-exchanged water were mixed with TK Homomixer (at 12,000 rpm for 10 minutes), and the mixture was filtered. The resulting cake and 300 parts of ion-exchanged water were mixed with TK Homomixer (at 12,000 rpm for 10 minutes), and the mixture was filtered thereby obtaining a cake 1.

The cake 1 was dried at 45° C. for 48 hours in a circulating air drier and then sieved with a 75 um mesh sieve, thereby obtaining Toner 1.

EXAMPLE 2

<Synthesis of Fine Resin Particle Dispersion 2>

683 Parts of water, 6 parts of a sodium salt of sulfuric acid ester of ethylene oxide adduct of methacrylic acid (Eleminol RS-30, made by Sanyo Chemical Industries), 83 parts of styrene, 83 parts of methacrylic acid, 110 parts of butyl acrylate and 1 part of ammonium persulfate were charged in a reaction vessel equipped with a stirrer and a thermometer and stirred at 400 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (Fine Resin Particle Dispersion 2) of a vinyl resin (copolymer of styrene-methacrylic acid-butyl acrylate-sodium salt of sulfuric acid ester of ethylene oxide adduct of methacrylic acid). Fine Resin Particle Dispersion 2 had a volume average particle size of 200 nm when measured with LA-920. Part of Fine Resin Particle Dispersion 2 was dried to isolate the resin component.

Preparation of Toner 2

Toner 2 was prepared in the same manner as described in Preparation of Toner 1 except that Fine Resin Particle Dispersion 2 was substituted for Fine Resin Particle Dispersion 1 and that the washing of the filter cake was performed as follows.

The filter cake was mixed with 300 parts of ion-exchanged water at 30° C. using TK Homomixer (at 12,000 rpm for 10 minutes), and the mixture was filtered. Such mixing and filtration treatment was repeated thrice in total.

EXAMPLE 3

<Synthesis of Fine Resin Particle Dispersion 3>

683 Parts of water, 9 parts of a sodium salt of sulfuric acid ester of ethylene oxide adduct of methacrylic acid (Eleminol RS-30, made by Sanyo Chemical Industries), 83 parts of styrene, 83 parts of methacrylic acid, 110 parts of butyl acrylate and 1 part of ammonium persulfate were charged in a reaction vessel equipped with a stirrer and a thermometer and stirred at 400 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (Fine Resin Particle Dispersion 3) of a vinyl resin (copolymer of styrene-methacrylic acid-butyl acrylate-sodium salt of sulfuric acid ester of ethylene oxide adduct of methacrylic acid). Fine Resin Particle Dispersion 3 had a volume average particle size of 200 nm when measured with LA-920. Part of Fine Resin Particle Dispersion 3 was dried to isolate the resin component.

Preparation of Toner 3

Toner 3 was prepared in the same manner as described in Preparation of Toner 1 except that Fine Resin Particle Dispersion 3 was substituted for Fine Resin Particle Dispersion 1 and that the washing of the filter cake was performed as follows.

The filter cake was mixed with 300 parts of ion-exchanged water at 30° C. using TK Homomixer (at 12,000 rpm for 10 minutes), and the mixture was filtered. Such mixing and filtration treatment was repeated four times in total.

EXAMPLE 4

Preparation of Toner 4

Toner 4 was prepared in the same manner as described in Preparation of Toner 1 except that the washing of the filter cake was performed as follows. The filter cake was mixed with 300 parts of ion-exchanged water at 20° C. using TK Homomixer (at 8,000 rpm for 10 minutes), and the mixture was filtered. Such mixing and filtration treatment was repeated twice in total.

EXAMPLE 5

Preparation of Toner 5

Toner 5 was prepared in the same manner as described in Preparation of Toner 1 except that the washing of the filter cake was performed as follows. The filter cake was mixed with 300 parts of ion-exchanged water at 25° C. using TK Homomixer (at 10,000 rpm for 10 minutes), and the mixture was filtered. Such mixing and filtration treatment was repeated twice in total.

EXAMPLE 6

Preparation of Toner 6

<Polymerization>

753 Parts of Pigment-Wax Dispersion 1, 154 parts of Prepolymer 1 and 3.8 parts of Ketimine 1 were charged in a vessel and mixed with TK Homomixer (manufactured by Tokushu Kika Kogyo Co., Ltd.) at 5,000 rpm for one minute. The mixture was then mixed with 1,200 parts of Aqueous Phase 1 with TK Homomixer at 13,000 rpm for 20 minutes, thereby obtaining an emulsified slurry 2.

Toner 6 was prepared in the same manner as described in Preparation of Toner 1 except that emulsified slurry 2 was substituted for the emulsified slurry 1.

EXAMPLE 7

Preparation of Toner 7

<Synthesis of Low-molecular Weight Polyester 2>

553 Parts of an ethylene oxide (2 mole) adduct of bisphenol A, 196 parts of a propylene oxide (2 mole) adduct of bisphenol A, 210 parts of terephthalic acid, 79 parts of adipic acid and 2 parts of dibutyltin oxide were charged in a reaction vessel equipped with a condenser, a stirrer and a nitrogen gas feed pipe, and reacted at 230° C. under ambient pressure for 8 hours. The reaction was further continued for 5 hours at a reduced pressure of 10–15 mmHg. 26 Parts of trimellitic anhydride was added to the reaction vessel and the mixture was reacted at 180° C. under ambient pressure for 2 hours, thereby obtaining a low-molecular weight polyester 2 having a number average molecular weight of 2400, a weight average molecular weight of 6200, a Tg of 43° C. and an acid value of 15.

<Preparation of Toner 7>

Toner 7 was prepared in the same manner as described in Preparation of Toner 5 except that low-molecular weight polyester 2 was substituted for the low-molecular weight polyester 1.

COMPARATIVE EXAMPLE 1

Preparation of Toner 8

451 Parts of 0.1 M aqueous solution of $Na_3(PO_4)_2$ were added to 709 g of ion exchanged water and the mixture was heated at 60° C. with stirring at 12,000 rpm using TK Homomixer. To this mixture, 68 g of 1.0 M aqueous solution of $CaCl_2$ were gradually added, thereby obtaining an aqueous medium. Into TK Homomixer, 170 g of styrene, 30 g of 2-ethylhexyl acrylate, 10 g of carbon black (Regal 400 manufactured by Cabot Corporation), 60 g of paraffin wax (softening point: 70° C.), 5 g of di-tertbutylsalicylic acid metal compound and 10 g of styrene-methacrylic acid copolymer (molecular weight: 50,000, acid value 20 mg KOH/g) were charged and heated at 60° C. with stirring at 12,000 rpm for dissolution and dispersion. In the resulting dispersion was dissolved a polymerizataion initiator, 2,2'-azobis(2,4-dimethylvaleronitrile) (10 g), thereby obtaining a polymerizable monomer-containing liquid. The polymerizable monomer-containing liquid was then added to the above aqueous medium and the mixture was agitated at 60° C. in the atmosphere of nitrogen for 20 minutes using TK Homomixer at 10,000 rpm to form particles of the polymerizable monomer-containing liquid dispersed in the aqueous medium. While stirring with a paddle stirrer, the dispersion was reacted at 60° C. for 3 hours and then at 80° C. for 10 hours. After the completion of the polymerization, the reaction mixture was cooled to room temperature, mixed with a mixture of calcium phosphate and hydrochloric acid and then filtered. The solids phase was then washed with water and dried to obtain Toner 8.

COMPARATIVE EXAMPLE 2

<Preparation of Aqueous Dispersion of Wax 1>

In a 1000 ml four necked flask equipped with a stirrer, a thermometer, a nitrogen feed port and a condenser, 500 ml of deaerated distilled water, 28.5 g of Newcol 565C (manufactured by Japan Emulsifier Inc.) and 185.5 g of candelilla wax (No. 1 manufactured by Noda Wax Co., Ltd.) were placed. The contents in the flask were then heated with stirring under a nitrogen gas flow to 85° C., to which 5 N aqueous sodium hydroxide solution was added. The mixture was stirred at 75° C. for 1 hour and then cooled to room temperature to obtain an aqueous dispersion of wax 1.

<Preparation of Aqueous Dispersion of Colorant 1>

100 Grams of carbon black (Mogal L manufactured by Cabot Corporation and 25 g of sodium dodecylsulfate were mixed with 540 ml of distilled water and the mixture was stirred and then dispersed using a pressurizing dispersing device (MINI-LAB manufactured by Raney Inc.) to obtain an aqueous dispersion of colorant 1.

<Preparation of Aqueous Dispersion of High Molecular Weight Binder Resin 1>

In a 1000 ml four necked flask equipped with a stirrer, a thermometer, a nitrogen feed port and a condenser, 480 ml of distilled water, 0.5 g of sodium dodecylsulfate, 106.4 g of styrene, 43.2 g of n-butyl acrylate and 10.4 g of methacrylic acid were charged and heated with stirring under a nitrogen gas flow to 70° C., to which an aqueous solution containing 2.1 g of potassium persulfate dissolved in 120 ml of distilled water was added. The mixture was then reacted at 70° C. for 3 hours. After completion of the polymerization, the reaction mixture was cooled to room temperature to obtain an aqueous dispersion of colorant 1.

<Preparation of Aqueous Dispersion of Low Molecular Weight Binder Resin 2>

In a 5000 ml four necked flask equipped with a stirrer, a thermometer, a nitrogen feed port and a condenser, 2400 ml of distilled water, 2.8 g of sodium dodecylsulfate, 620 g of styrene, 128 g of n-butyl acrylate, 52 g of methacrylic acid and 27.4 g of tert-dodecylmercaptan were charged and heated with stirring under a nitrogen gas flow to 70° C., to which an aqueous solution containing 11.2 g of potassium persulfate dissolved in 600 ml of distilled water was added. The mixture was then reacted at 70° C. for 3 hours. After completion of the polymerization, the reaction mixture was cooled to room temperature to obtain an aqueous dispersion of low molecular weight binder resin 2.

Preparation of Toner 9

In a 1000 ml separable flask equipped with a stirrer, a thermometer and a condenser, 47.6 g of the aqueous dispersion of high molecular weight binder resin 1, 190.5 g of the aqueous dispersion of low molecular weight binder resin 2, 7.7 g of the aqueous dispersion of wax 1, 26.7 g of the aqueous dispersion of colorant 1 and 252.5 ml of distilled water were charged and mixed with stirring, to which an aqueous 5 N sodium hydroxide solution was added to adjust the pH of the mixture to 9.5. With stirring, 77 ml of isopropanol and an aqueous surfactant solution containing 10 mg of fluorine containing nonionic surfactant (Fluorad FC-170C manufactured by Sumitomo 3M Inc.) were successively added to the flask. The contents in the flask were then reacted at 85° C. for 6 hours. After having been cooled to room temperature, the reaction mixture was mixed with aqueous 5 N sodium hydroxide solution so that the pH thereof was adjusted at 13. Then the mixture was filtered, and the solids were suspended in distilled water. This was again filtered, the solids were again suspended in distilled water and then filtered again. After the above repeated washing, the solids were finally dried to obtain Toner 9.

COMPARATIVE EXAMPLE 3

<Synthesis of Fine Resin Particle Dispersion 4>

683 Parts of water, 20 parts of a sodium salt of sulfuric acid ester of ethylene oxide adduct of methacrylic acid (Eleminol RS-30, made by Sanyo Chemical Industries), 138 parts of styrene, 138 parts of methacrylic acid and 1 part of ammonium persulfate were charged in a reaction vessel equipped with a stirrer and a thermometer and stirred at 600 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (Fine Resin Particle Dispersion 4) of a vinyl resin (copolymer of styrene-methacrylic acid-sodium salt of sulfuric acid ester of ethylene oxide adduct of methacrylic acid). Fine Resin Particle Dispersion 4 had a volume average particle size of 30 nm when measured with LA-920. Part of Fine Resin Particle Dispersion 4 was dried to isolate the resin component.

Preparation of Toner 10

Toner 10 was prepared in the same manner as described in Preparation of Toner 1 except that Fine Resin Particle Dispersion 4 was substituted for Fine Resin Particle Dispersion 1.

COMPARATIVE EXAMPLE 4

<Synthesis of Fine Resin Particle Dispersion 5>

683 Parts of water, 3 parts of a sodium salt of sulfuric acid ester of ethylene oxide adduct of methacrylic acid (Eleminol RS-30, made by Sanyo Chemical Industries), 83 parts of styrene, 83 parts of methacrylic acid, 110 parts of butyl acrylate and 1 part of ammonium persulfate were charged in a reaction vessel equipped with a stirrer and a thermometer and stirred at 300 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (Fine Resin Particle Dispersion 5) of a vinyl resin (copolymer of styrene-methacrylic acid-butyl acrylate-sodium salt of sulfuric acid ester of ethylene oxide adduct of methacrylic acid). Fine Resin Particle Dispersion 5 had a volume average particle size of 400 nm when measured with LA-920. Part of Fine Resin Particle Dispersion 5 was dried to isolate the resin component.

Preparation of Toner 11

Toner 11 was prepared in the same manner as described in Preparation of Toner 1 except that Fine Resin Particle Dispersion 5 was substituted for Fine Resin Particle Dispersion 1.

COMPARATIVE EXAMPLE 5

Preparation of Toner 12

Example 3 was repeated in the same manner as described except that the washing of the filter cake was performed as follows.

The filter cake was mixed with 300 parts of ion-exchanged water at 40° C. using TK Homomixer (at 12,000 rpm for 20 minutes), and the mixture was filtered. Such mixing and filtration treatment was repeated four times in total, thereby obtaining Toner 12.

Properties of Toners 1 to Toner 12

Each of Toners 1 to 12 obtained above (100 parts), 0.7 part of hydrophobic silica and 0.3 parts of hydrophobized titanium oxide were mixed in a Henschel mixer. The physical properties, i.e. volume average particle diameter Dv, number average particle diameter Dn, Dv/Dn ratio, sphericity, BET specific surface area BET-SA, amount of the fine resin particles, fixation efficiency, and hot-offset resistance in terms of the temperature above which hot offset occurs, of the thus obtained toners are shown in Table 1-1 and 1-2.

TABLE 1-1

| Example No. | Toner No. | Dv (μm) | Dn (μm) | Dv/Dn | Average sphericity | BET-SA ($m^2/g$) |
|---|---|---|---|---|---|---|
| 1 | 1 | 5.99 | 5.70 | 1.05 | 0.943 | 2.5 |
| 2 | 2 | 6.13 | 5.62 | 1.09 | 0.955 | 1.8 |
| 3 | 3 | 5.82 | 5.29 | 1.10 | 0.951 | 2.3 |
| 4 | 4 | 5.09 | 4.24 | 1.20 | 0.927 | 3.8 |
| 5 | 5 | 6.33 | 5.65 | 1.12 | 0.917 | 3.1 |
| 6 | 6 | 6.17 | 5.61 | 1.10 | 0.929 | 2.6 |
| 7 | 7 | 4.72 | 4.03 | 1.17 | 0.941 | 2.7 |
| Comp. 1 | 8 | 6.79 | 5.52 | 1.23 | 0.981 | — |
| Comp. 2 | 9 | 6.61 | 5.55 | 1.19 | 0.938 | — |
| Comp. 3 | 10 | 5.64 | 4.90 | 1.15 | 0.947 | 0.8 |
| Comp. 4 | 11 | 5.17 | 4.27 | 1.21 | 0.938 | 2.4 |
| Comp. 5 | 12 | 4.60 | 3.93 | 1.17 | 0.951 | 0.9 |

TABLE 1-2

| Example No. | Toner No. | Amount of Fine Resin Particles (wt %) | Fixation Efficiency (° C.) | Hot-Offset Occurring Temperature |
|---|---|---|---|---|
| 1 | 1 | 2.2 | 155 | above 240° C. |
| 2 | 2 | 1.5 | 165 | above 240° C. |
| 3 | 3 | 0.8 | 160 | above 240° C. |
| 4 | 4 | 4.6 | 130 | above 240° C. |
| 5 | 5 | 2.9 | 150 | above 240° C. |
| 6 | 6 | 2.6 | 160 | above 240° C. |
| 7 | 7 | 3.1 | 165 | above 240° C. |
| Comp. 1 | 8 | — | 180 | above 240° C. |
| Comp. 2 | 9 | — | 175 | above 240° C. |
| Comp. 3 | 10 | 2.6 | 165 | 180° C. |
| Comp. 4 | 11 | 1.8 | 180 | 180° C. |
| Comp. 5 | 12 | 0.6 | 165 | 170° C. |

Method of measuring the volume average particle diameter Dv, number average particle diameter Dn, average sphericity, amount of the fine resin particles, fixation efficiency, and hot-offset resistance shown in above Table 1-1 and 1-2 are as follows.

Average Particle Diameter:

The particle diameter distribution of the toner is measured with a Coulter Multisizer II (manufactured by Coulter Electronics, Inc.) to which an interface (manufactured by Nikkaki Inc.) capable of outputting number-based and volume-based distribution and a personal computer (PC9801 manufactured by NEC Inc.) are connected. As an electrolytic solution for measurement, an aqueous 1% by weight NaCl solution of first-grade sodium chloride is used. A dispersant (0.5–5 ml of a salt of alkylbenzenesulfonic acid) is added to 10 to 15 ml of the above electrolytic solution, to which 2 to 20 mg of a sample to be measured are added. The resulting mixture is subjected to a dispersing treatment for about 1–3 minute to about 3 minutes in an ultrasonic dispersing machine. The electrolytic solution (100–200 ml) is taken in another vessel, to which a predetermined amount of the dispersed sample is added. Using an aperture of 100 μm in the above particle size distribution measuring device, the particle size distribution is measured on the basis of the particle number with the Coulter counter for 30,000 particles having a diameter in the range of 2–40 μm.

Average Sphericity:

The sphericity is measured using a flow particle image analyzer, "FPIA-2100", manufactured by SYSMEX Co., Ltd.). Water (100 to 150 ml) after being passed through a 0.45 μm filter is mixed with 0.1 to 0.5 ml of a surfactant (preferably a salt of alkylbenzenesulfonate). To the resulting solution, 0.1 to 0.5 g of a sample is added. This is subjected to a dispersion treatment for 1 to 3 minutes with an ultrasonic disperser to form a sample dispersion liquid having a concentration of 3000 to 10000 particles/μl. The sample dispersion liquid is measured for the average sphericity of particles using the above flow type particle image analyzer. From the area of the two-dimensional image of each of the particles measured with a CCD camera, a diameter of a circle having the same area is calculated as a circle-equivalent diameter of the particle. The average sphericity is calculated by dividing a sum of the circle-equivalent diameters of the particles by the number of the particles as follows.

$$\text{Average sphericity}=\Sigma(L_0/L)/n$$

wherein $L_0$ represents a spherical length of a circle having the same area as the projected area of a toner particle and L represents a peripheral length of the projected image of the toner particle. The sphericity provides an index for evaluating the shape of a toner particle. The closer the shape of the toner to a true circle, the nearer becomes the sphericity to 1. As the shape becomes complicated, the sphericity becomes smaller.

Amount of Fine Resin Particles:

A standard addition method is adopted. Predetermined amounts (0.01, 0.10, 1.00, 3.00 and 10% by weight) of styrene-acrylic resin fine particles are added as a standard (finger print component) to a sample toner and each mixture is subjected to GC-MS (gas chromatography and mass spectrometry) to determine the amount of styrene monomer produced by thermal decomposition of styrene-acrylic resin fine particles of the sample toner. The operation condition of GC-MS are as follows:

GC-MS: Thermal Decomposition Gas Chromatograph Mass Spectrometer (QR-5000, manufactured by Shimadzu Corporation)

Thermal decomposition temperature: 590° C., 12 seconds

Column: DB-1 (length: 30 m)

Inside diameter: 0.25 mm

Film: 0.25 μm

Column temperature: first retained at 40° C.(retention time: 2 minutes), then heated to 300° C. at a heating rate of 10° C./minute Vaporization chamber temperature: 300° C.

Fixation Efficiency:

Copies are produced on papers (thick paper: Copy Paper 135 manufactured by NBS Ricoh Company, Ltd.) using a copying machine (imagio Neo 450 manufactured by Ricoh Company, Ltd.) modified so that the toner is used in an amount of 1.0±0.1 $mg/cm^2$ for developing a solid image and the temperature of the fixation belt can be varied. The fixing efficiency is evaluated in terms of the minimum temperature of the fixing roll at which the residual rate of the image density is 70% or more when the fixed image is rubbed with a pat. The lower the minimum fixing roll temperature, the better is the fixing efficiency.

Hot Offset:

Copies are produced on papers (plain paper: Type 6200 manufactured by Ricoh Company, Ltd.) using the same copying machine as that in the above fixation efficiency test. The occurrence of hot offsetting is determined with naked eyes. Hot offset is evaluated in terms of the temperature of the fixing roll at which hot offset occurs. The higher the hot offset-occurring temperature, the better is anti-offsetting property.

Further, each of Toners 1 to 12 treated with the external additive (5 parts) was mixed with 95 parts of a carrier (copper-zinc ferrite carrier having an average particle diameter of 40 $\mu$m) to obtain two-component developers. Each of the developers was charged in an image forming machine (imagio Neo 450 manufactured by Ricoh Company, Ltd.) capable of printing 45 prints (with A4 size) per 1 minute. An image chart having an image area of 5% was reproduced to obtain 100,000 copies. After the production of the initial copy, and 10,000th and 100,000th copies, amount of charge of the toner, image density, background stains, removability of residual toner by cleaning, and occurrence of filming of photoconductor and developing roller were evaluated. The results are summarized in Tables 2-1 and 2-2.

In Tables 2-1 and 2-2, the amount of charge of the developer, image density, background stains, removability of residual toner by cleaning, and occurrence of filming of photoconductor and developing roller are measured as follows.

Amount of Charge:

The two-component developer is measured for a charge amount by a blow off method using an electrometer. The amount of the toner in the developer is held in the range of 4.5 to 5.5% by weight.

Image Density:

Image density is measured using a spectrodensitometer (Model 938 produced by X-Rite, Inc.).

Background Stain:

The photoconductor is exposed to a white image and the electrostatic latent image is subjected to a developing treatment. The developed image is transferred to a transfer tape and the image density of the tape is measured using a spectrodensitometer (Model 938 produced by X-Rite, Inc.). A difference in image density between the transfer tape and a control tape which has not been subjected to the transfer of the white image represents the background stain. The greater the difference, the larger becomes the amount of the toner on the white image, i.e. the greater becomes the background stain.

Removability of Residual Toner:

The surface of the photoconductor which has passed through the cleaning step is contacted with Scotch Tape (manufactured by Sumitomo 3M Inc.) for collection of residual toner. The tape on a white paper is measured for density using McBeath Reflection Densitometer RD514. A difference in density between the transfer tape and a control tape which has not been subjected to the collection of residual toner represents the removability. The removability is evaluated as follows:

| | |
|---|---|
| Good: | the difference is 0.01 or less |
| No good: | the difference is greater than 0.01 |

Filming:

The surfaces of the developing sleeve and photoconductor are observed to examine whether toner filming occurred. Evaluation is rated as follows:

Good: no filming is found

Fair: streaks of toner filming are found

No good: toner filming occurs on entire surface

TABLE 2-1

| Example | Toner | Amount of Charge ($-\mu$C/g) | | | Image Density | | | Background Stains | | |
|---|---|---|---|---|---|---|---|---|---|---|
| No. | No. | Initial | $10^4$th | $10^5$th | Initial | $10^4$th | $10^5$th | Initial | $10^4$th | $10^5$th |
| 1 | 1 | 32.1 | 33.2 | 30.6 | 1.41 | 1.45 | 1.41 | 0.01 | 0.00 | 0.01 |
| 2 | 2 | 29.8 | 31.4 | 26.9 | 1.45 | 1.48 | 1.40 | 0.01 | 0.00 | 0.02 |
| 3 | 3 | 35.3 | 37.2 | 32.2 | 1.46 | 1.47 | 1.41 | 0.00 | 0.01 | 0.01 |
| 4 | 4 | 27.5 | 30.1 | 26.2 | 1.45 | 1.49 | 1.40 | 0.01 | 0.01 | 0.02 |
| 5 | 5 | 30.4 | 32.4 | 29.4 | 1.44 | 1.46 | 1.39 | 0.00 | 0.01 | 0.01 |
| 6 | 6 | 28.5 | 31.6 | 26.9 | 1.35 | 1.40 | 1.33 | 0.01 | 0.00 | 0.02 |
| 7 | 7 | 36.8 | 38.4 | 33.3 | 1.42 | 1.44 | 1.38 | 0.00 | 0.01 | 0.01 |
| Comp. 1 | 8 | 29.9 | — | — | 1.29 | — | — | 0.03 | — | — |
| Comp. 2 | 9 | 32.4 | 18.9 | — | 1.40 | 1.45 | — | 0.02 | 0.43 | — |
| Comp. 3 | 10 | 26.6 | — | — | 1.39 | — | — | 0.02 | — | — |
| Comp. 4 | 11 | 30.3 | — | — | 1.43 | — | — | 0.01 | — | — |
| Comp. 5 | 12 | 28.6 | — | — | 1.40 | — | — | 0.01 | — | — |

TABLE 2-2

| Example | Toner | Removability of Toner by Cleaning | | | Filming after $10^5$th | Overall Evalu- |
|---|---|---|---|---|---|---|
| No. | No. | Initial | $10^4$th | $10^5$th | Copies | ation |
| 1 | 1 | good | good | good | good | excellent |
| 2 | 2 | good | good | good | good | excellent |
| 3 | 3 | good | good | good | good | excellent |
| 4 | 4 | good | good | good | good | excellent |
| 5 | 5 | good | good | good | good | excellent |
| 6 | 6 | good | good | good | good | excellent |
| 7 | 7 | good | good | good | good | excellent |
| Comp. 1 | 8 | no good | — | — | — | no good |
| Comp. 2 | 9 | good | good | — | — | no good |
| Comp. 3 | 10 | no good | — | — | — | no good |
| Comp. 4 | 11 | good | — | — | — | no good |
| Comp. 5 | 12 | good | — | — | — | no good |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2002-080997 filed Mar. 22, 2002, inclusive of the specification and claims are hereby incorporated by reference herein.

What is claimed is:

1. A toner, comprising:

a colorant, a binder resin comprising a modified polyester, and one or more fine resin particles having a weight average particle diameter of 50 to 300 nm and being present on an outer surface of said toner, wherein said toner has a BET specific surface area of 1.5 to 4.0 $m^2/g$.

2. A toner as claimed in claim 1, wherein said toner binder further comprises an unmodified polyester, and wherein the weight ratio of said modified polyester to said unmodified polyester ranges from 5:95 to 75:25.

3. A toner as claimed in claim 1, wherein said binder resin has an acid value of 0.5 to 40 mg KOH/g.

4. A toner as claimed in claim 1, wherein said toner binder has a glass transition point of 40 to 70° C.

5. A toner as claimed in claim 1, wherein said one or more fine resin particles comprise a vinyl resin, a polyurethane resin, an epoxy resin, a polyester resin or a mixture thereof.

6. A toner as claimed in claim 1, wherein the amount of said one or more fine resin particles is 0.5 to 5.0% by weight, as measured by gas chromatography-mass analysis, based on the weight of said toner.

7. A toner as claimed in claim 1, having a volume average particle diameter Dv of 4 to 8 $\mu$m.

8. A toner as claimed in claim 1, having a volume average particle diameter of Dv and a number average particle diameter of Dn and wherein the ratio Dv/Dn is 1.25 or less.

9. A toner as claimed in claim 1, having a sphericity of 0.96 to 0.90.

10. A toner as claimed in claim 1, further comprising at least one additive selected from the group consisting of a releasing agent, a charge controlling agent and an external additive.

11. A toner as claimed in claim 1, obtained by a method comprising:

dispersing a toner composition, which comprises an organic solvent comprising said colorant, an active hydrogen-containing compound and a modified polyester prepolymer capable of reacting with said active hydrogen-containing compound and dispersed or dissolved in said organic solvent, in an aqueous medium comprising said one or more fine resin particles to obtain a dispersion;

reacting said prepolymer with said active hydrogen-containing compound to polymerize said prepolymer to obtain said modified polyester wherein said dispersion comprises toner particles dispersed in said aqueous medium and comprising said modified polyester and said colorant; and removing said organic solvent and water from said dispersion wherein a part of said one or more fine resin particles are present on an outer surface of said toner particles.

12. A toner as claimed in claim 11, wherein said removing is carried out by evaporation under vacuum and/or with heating.

13. A toner as claimed in claim 11, wherein said removing is carried out by filtration.

14. A developer comprising said toner according to claim 1.

15. A container comprising said developer according to claim 14.

16. An image forming apparatus comprising said container according to claim 15.

17. An image forming method comprising developing an electrostatic image on a photoconductor with said toner according to claim 1, cleaning said photoconductor by removing a residual toner on said photoconductor, and recycling the removed toner to said developing step.

18. A method of producing said toner according to claim 1, comprising:

dispersing a toner composition, which is in the form of an organic dispersion or solution and which comprises an organic solvent, a colorant, an active hydrogen-containing compound and a modified polyester prepolymer capable of reacting with said active hydrogen-containing compound, in an aqueous medium comprising fine resin particles having a weight average particle diameter of 50 to 300 nm to obtain an aqueous dispersion;

reacting said prepolymer with said active hydrogen-containing compound to polymerize said prepolymer and to obtain a modified polyester wherein said aqueous dispersion comprises toner particles dispersed in said aqueous medium and comprising said modified polyester, and said colorant; and removing said organic solvent and water from said dispersion wherein a part of said one or more fine resin particles are present on outer surfaces of said toner particles.

* * * * *